US011290807B2

(12) United States Patent
Akiyama et al.

(10) Patent No.: US 11,290,807 B2
(45) Date of Patent: Mar. 29, 2022

(54) SPEAKER DEVICE

(71) Applicant: AGC Inc., Tokyo (JP)

(72) Inventors: Jun Akiyama, Tokyo (JP); Kento Sakurai, Tokyo (JP)

(73) Assignee: AGC Inc., Tokyo (JP)

( * ) Notice: Subject to any disclaimer, the term of this patent is extended or adjusted under 35 U.S.C. 154(b) by 12 days.

(21) Appl. No.: 17/010,911

(22) Filed: Sep. 3, 2020

(65) Prior Publication Data

US 2020/0404412 A1 Dec. 24, 2020

Related U.S. Application Data

(63) Continuation of application No. PCT/JP2019/007841, filed on Feb. 28, 2019.

(30) Foreign Application Priority Data

Mar. 6, 2018 (JP) ..... JP2018-039879

(51) Int. Cl.
*H04R 1/28* (2006.01)

(52) U.S. Cl.
CPC ..... *H04R 1/2834* (2013.01)

(58) Field of Classification Search
CPC .. H04R 31/003; H04R 2307/025; H04R 7/04; H04R 2307/023; H04R 1/2834; H04R 7/00; H04R 2207/021; H04R 2207/00
USPC ..... 381/423, 398, 431, 345, 150, 184, 172; 181/157, 163, 148, 132, 164
See application file for complete search history.

(56) References Cited

U.S. PATENT DOCUMENTS

2010/0284555 A1* 11/2010 Suzuki ..... H04R 15/00 381/300
2013/0251176 A1 9/2013 Goto et al.
2018/0184208 A1* 6/2018 O'Brien ..... H04R 7/26
2019/0030862 A1 1/2019 Akiyama

FOREIGN PATENT DOCUMENTS

JP 2010-263512 A 11/2010
JP 2013-198082 A 9/2013
JP 2016-23000 A 2/2016
WO WO 2017/175682 A1 10/2017

OTHER PUBLICATIONS

International Search Report dated March 26, 2019 in PCT/JP2019/007841 filed Feb. 28, 2019, 1 page

* cited by examiner

*Primary Examiner* — Norman Yu
(74) *Attorney, Agent, or Firm* — Oblon, McClelland, Maier & Neustadt, L.L.P.

(57) ABSTRACT

The speaker device (100) includes a diaphragm (11), an exciter (13) which vibrates in response to an input electrical signal, and a vibration-transmitter (15) which is connected to both the diaphragm (11) and the exciter (13) and transmits the vibration of the exciter (13) to the diaphragm (11), in which the diaphragm (11) has a loss coefficient at 25° C. of $1\times10^{-2}$ or higher and the vibration-transmitter (15) has a specific elastic modulus of 20 $mm^2/s^2$ or higher.

20 Claims, 2 Drawing Sheets

SPEAKER DEVICE

TECHNICAL FIELD

The present invention relates to a speaker device in which a diaphragm is excited to produce sounds.

BACKGROUND ART

A technique is generally known in which a diaphragm is vibrated with an exciter including an excitation part to produce sounds from the diaphragm (see, for example, Patent Document 1). Patent Document 1 describes a configuration including: a vibration speaker for converting voice signals into vibrations, which has been disposed on the lower surface of a ceiling board; and a diaphragm disposed directly on a vibration-transmitting surface of the vibration speaker. According to this configuration, the vibration speaker excites the diaphragm, thereby causing the diaphragm to produce sounds according to voice vibrations.

CITATION LIST

Patent Literature

Patent Document 1: JP-A-2016-23000

SUMMARY OF INVENTION

Technical Problem

Regarding such diaphragm-containing speaker devices, various speaker devices having improved design are being proposed from the standpoint of enhanced designability. Among these is a speaker device which includes a diaphragm made of a transparent material, such as a glass sheet or an acrylic board, so that the diaphragm is utilized as a display in addition to producing sound.

In many diaphragm-operating methods, an exciter is directly bonded to a diaphragm to vibrate the diaphragm. These methods can efficiently transmit vibrations from voice signals to the diaphragm, however, these methods cause problems in designability, such as restrictions on exciter shape due to the layout in the space between the ceiling and the diaphragm, and a problem of see-through of portion of the excitation part of the exciter directly bonded to the diaphragm.

Accordingly, an object of the present invention is to provide a speaker device which retains acoustic performance and can exhibit excellent design without impairing designability of the diaphragm.

Solution to Problem

The present invention includes the following configurations.

(1) A speaker device including
- a diaphragm,
- an exciter that generates vibration in response to an input electrical signal, and
- a vibration-transmitter that is connected to both the diaphragm and the exciter and transmits the vibration from the exciter to the diaphragm,
- in which the diaphragm has a loss coefficient at 25° C. of $1\times10^{-2}$ or higher and
- the vibration-transmitter has a specific elastic modulus of 20 $mm^2/s^2$ or higher.

(2) The speaker device according to (1), in which the diaphragm has light transmitting properties.

(3) The speaker device according to (1) or (2), in which the diaphragm has a longitudinal wave acoustic velocity in a sheet-thickness-direction of $3.0\times10^3$ m/s or higher.

(4) The speaker device according to any one of (1) to (3), in which a joint surface where the vibration-transmitter bonds to the diaphragm has an area of 1/100 or less of an area of the diaphragm.

(5) The speaker device according to any one of (1) to (4), in which the vibration-transmitter includes a rod member connected to both the diaphragm and the exciter.

(6) The speaker device according to (5), in which the rod member is connected to the diaphragm by a rod-holding member.

(7) The speaker device according to any one of (1) to (6), in which the diaphragm is a diaphragm composite including two or more substrates, the diaphragm composite includes an interlayer of a resin or liquid between at least one pair of substrates among the substrates.

(8) The speaker device according to (7), in which the interlayer is a liquid layer having a thickness of 100 μm or less.

(9) The speaker device according to (8), in which the liquid layer has a viscosity coefficient at 25° C. of $1\times10^{-4}$ to $1\times10^3$ Pa·s and a surface tension at 25° C. of 15-80 mN/m.

(10) The speaker device according to (8) or (9), in which the liquid layer includes at least one member selected from the group consisting of propylene glycol, a dimethyl silicone oil, a methyl phenyl silicone oil, a methyl hydrogen silicone oil, and modified silicone oils.

(11) The speaker device according to any one of (7) to (10), in which each of the substrates that constitute the at least one pair of substrates among the substrates has a specific elastic modulus of $2.5\times10^7$ $m^2/s^2$ or higher.

(12) The speaker device according to any one of (7) to (11), in which a mass ratio between the two substrates constituting the one pair of substrates is 0.1-10.0.

(13) The speaker device according to any one of (7) to (12), in which each of the two substrates constituting the one pair of substrates has a thickness of 0.01-15 mm.

(14) The speaker device according to any one of (7) to (13), in which the diaphragm composite includes at least one of a physically strengthened glass sheet or a chemically strengthened glass sheet.

(15) The speaker device according to any one of (7) to (14), in which the diaphragm composite includes a coating layer or film layer formed on at least one outermost surface of the diaphragm composite.

(16) The speaker device according to any one of (7) to (15), in which the diaphragm composite includes a seal material that does not hinder vibration of the diaphragm composite and is provided to at least some of an outer peripheral edge portion of the diaphragm composite.

Advantageous Effects of the Invention

The speaker device of the present invention retains acoustic performance and can exhibit excellent design without impairing designability of the diaphragm.

DESCRIPTION OF EMBODIMENTS

Figure 1:
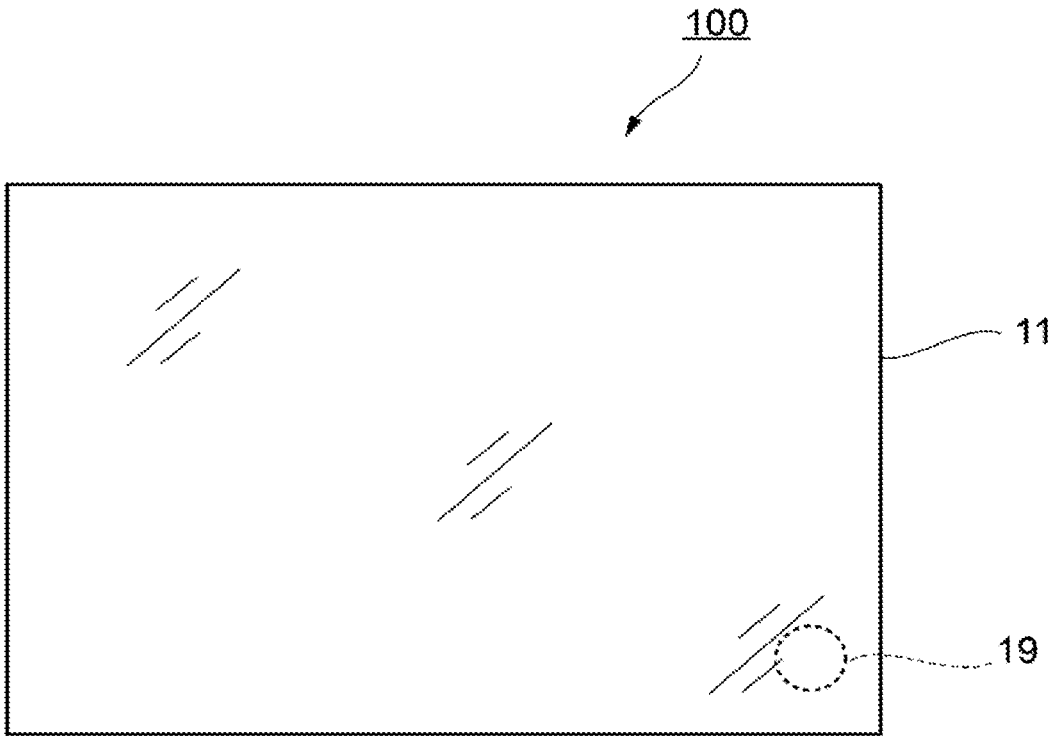
FIG. 1 is a front view schematically showing a speaker device according to the present invention.

Details and other features of the present invention are described below based on embodiments of the present invention. Here, in the following drawings, the same or corresponding reference numeral is assigned to the same or corresponding members or parts, and duplicated description is omitted. In addition, unless otherwise specified, the drawings are not intended to show a relative ratio among members or parts. Accordingly, specific dimensions may be properly selected in the context of the following non-limiting embodiments.

Furthermore, "-" indicating a numerical range in the present description is used in the sense of including the numerical values set forth before and after the "-" as a lower limit value and an upper limit value.

Figure 2:
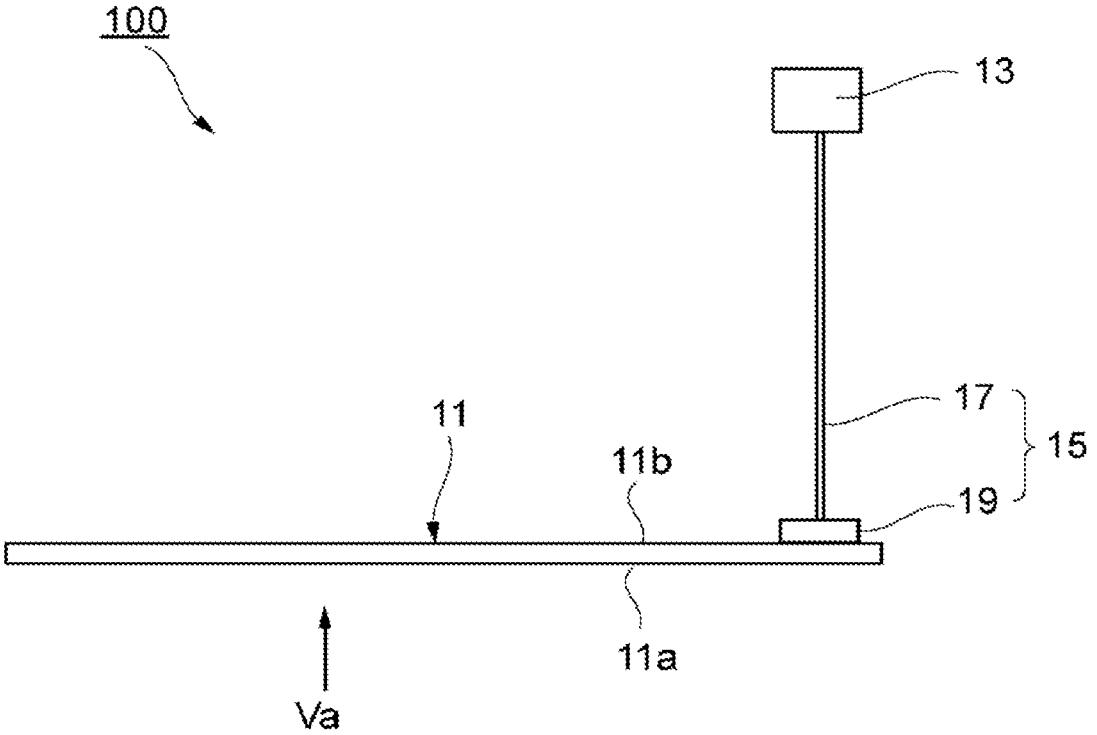
FIG. 2 is a plan view schematically showing a speaker device according to the present invention.
Figure 3:
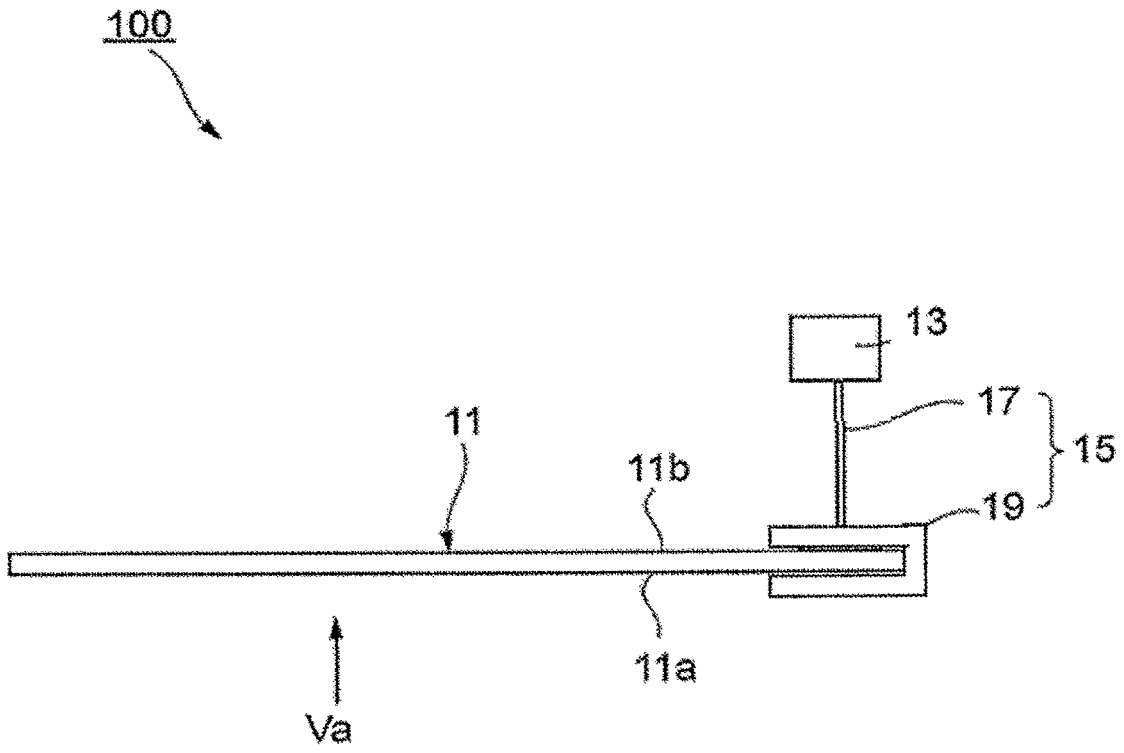
FIG. 3 is a plan view schematically showing a speaker device according to the present invention.

FIG. 1 is a front view schematically showing a speaker device according to the present invention, and FIG. 2 and FIG. 3 are plan views schematically showing speaker devices according to the present invention.

As shown in FIG. 1, FIG. 2, and FIG. 3, the speaker devices 100 each include: a diaphragm 11 having light transmitting properties; an exciter (vibration exciter) 13 which vibrates in response to an input electrical signal; and a vibration-transmitter 15 which is connected to the diaphragm 11 and the exciter 13 and transmits the vibration of the exciter 13 to the diaphragm 11.

The diaphragm 11, which will be described later in detail, is excited by the vibration generated by the exciter 13 to produce a sound. It is preferable that the diaphragm 11 has light transmitting properties such that the other side of the diaphragm 11 can be seen through when the diaphragm 11 is viewed roughly from the direction of the arrow Va of FIG. 2. The diaphragm 11 may be a single substrate or may be a diaphragm composite including a plurality of substrates (the diaphragm composite will be described later in detail). The diaphragm 11 may be a flat sheet or a curved sheet. Furthermore, the diaphragm 11 may have no light transmitting properties.

The diaphragm 11 includes a material having a high longitudinal wave acoustic velocity. Examples of the material include a glass sheet, a light-transmitting ceramic, a single-crystal substance such as sapphire, etc.

The diaphragm 11 is supported by an appropriate supporting member in accordance with intended uses of the speaker device 100. For example, the supporting member may be legs extending from corner portions of the diaphragm 11 on one side thereof in the sheet thickness direction, or may be a holding material, e.g., a cushion, which does not easily damp the caused vibration.

The exciter 13 includes a coil part electrically connected to an external device, a magnetic circuit part, and an excitation part connected to the coil part or the magnetic circuit part, although these components are not shown in the drawings. When an electrical signal of a sound is input from the external device to the coil part, an interaction between the coil part and the magnetic circuit part causes the coil part or the magnetic circuit part to vibrate. This vibration of the coil part or magnetic circuit part is transmitted to the excitation part and then transmitted from the excitation part to the vibration-transmitter 15.

The vibration-transmitter 15 includes a rod member 17, which has a rod shape. As the rod member 17, a metal, a resin, a glass-fiber-reinforced plastic, a carbon-fiber-reinforced plastic, or the like can be used. One end of the rod member 17 in the axial-direction is fixed to the excitation part of the exciter 13, while the other end thereof is fixed to the diaphragm 11 side. The material of the rod member 17 is preferably one having high rigidity, from the standpoint of transmitting vibrations, has a specific elastic modulus (value obtained by dividing Young's modulus by density) of preferably 20 $mm^2/s^2$ or higher, more preferably 30 $mm^2/s^2$ or higher, still more preferably 40 $mm^2/s^2$ or higher. The length of the rod member 17 is not particularly limited, and can be, for example, 1 cm or longer, or 30 cm or longer, or 100 cm or longer. Meanwhile, too long rod lengths cause the rod member to resonate, resulting in a noise, or cause the rod member to produce a vibration-damping effect to reduce the sound pressure produced by the vibrating surface. Hence, the length of the rod member 17 is preferably 500 cm or shorter, more preferably 200 cm or shorter.

In the example shown in each figure, the other end of the rod member 17 is connected to the diaphragm 11 by a rod-holding member 19. The rod-holding member 19 is bonded to the back surface (second main surface 11*b*) of the diaphragm 11, which is on the side opposite from the Va-direction front-side surface (first main surface 11*a*) thereof. This rod-holding member 19 is, for example, a block made of glass, and is bonded or fusion-bonded to the rod member 17 and thereafter connected to the diaphragm 11 with, for example, an adhesive. The connection between the rod-holding member 19 and the diaphragm 11 can be attained by inserting some of the diaphragm 11 into the rod-holding member 19 as shown in FIG. 3. The connection between the rod member 17 and the rod-holding member 19 may be fastening with, for example, a screw.

It is preferable that the rod member 17 and the rod-holding member 19 are each made of a light-transmitting material. In this case, the rod member 17 and the rod-holding member 19, even after having been connected to the diaphragm 11, do not impair the light transmitting properties of the diaphragm 11. The rod-holding member 19 can increase the area of the joint surface with the diaphragm 11 to enhance the bonding strength, as compared with the case where the rod member 17 is directly bonded to the diaphragm 11. Besides being a glass block, the rod-holding member 19 can be a resin such as an acrylic, a light-transmitting ceramic, or a single-crystal material such as sapphire.

The joint surface between the rod member 17 (or the rod-holding member 19) and the diaphragm 11 is made less refractive, it becomes less noticeable when the diaphragm 11 is viewed from outside. Accordingly, it is preferable that the rod member 17 (or the rod-holding member 19) and the diaphragm 11 have close refractive index to each other as much as possible. The difference in refractive index therebetween is preferably 0.2 or less, more preferably 0.1 or less, still more preferably 0.05 or less. By making the rod member 17 (or the rod-holding member 19) and the diaphragm 11 have such a difference in refractive index, the joint surface therebetween can be visually recognized as a light-transmitting portion and does not impair the appearance.

When stress to be produced in applying vibration is small, for example, as in the case where the diaphragm 11 is small and lightweight, the other end of the rod member 17 may be directly fusion-bonded or bonded to the diaphragm 11 without using the rod-holding member 19. As a result, the joint surface between the diaphragm 11 and the rod member 17 has a reduced area and is less noticeable.

Meanwhile, when large stress is imposed on the rod-holding member 19, for example, as in the case where the diaphragm 11 is large, the rod-holding member 19 may be a non-light-transmitting rod-holding member made of, for example, a metal. In this case, the joint surface between the rod-holding member 19 and the diaphragm 11 is made to have a smaller area so that the light transmitting properties of the diaphragm 11 is not impaired as much as possible. The joint surface has preferably an area of 1/100 or less of an area of each main surface (first main surface 11*a* or second main surface 11*b*) of the diaphragm 11, and more preferably 1/200 or less, still more preferably 1/500 or less, of the area thereof. Meanwhile, from the standpoint of ensuring a strength of bonding between the rod-holding member 19 and the diaphragm 11, the area of the joint surface is preferably 1/10,000 or larger.

It is preferable that the rod member 17 or the rod-holding member 19 is bonded to the diaphragm 11 so that the direction of vibrations transmitted from the excitation part of the exciter 13 approximately coincides with a normal line for the main surface of the diaphragm 11. The angle formed by the axial direction of the rod member 17 and the direction of the normal line in the rod attachment position on the diaphragm 11 is preferably ±60°, more preferably ±30°, still more preferably ±10°. The smaller the angle between the vibration direction of the rod member 17 and the normal line for the diaphragm 11, the more efficiently vibrations can be transmitted to the diaphragm 11 and the more the sound pressure level can be heightened.

As shown in FIG. 1 and FIG. 2, the rod member 17 or the rod-holding member 19 has been connected to a corner portion of the rectangular diaphragm 11, in a plan view. However, the position of connection to the diaphragm 11 is not limited thereto, and may be any position by the sides of the rectangular shape or may be any desired position on the main surface so long as the designability of the diaphragm 11 is not impaired. The rod member 17 or the rod-holding member 19 may be connected to a member fixed to the diaphragm 11.

The vibration-transmitter 15 herein includes the rod member 17, which has a rod shape. However, the rod member 17 is not limited thereto, and may be one including a curved portion having at least one curved or bent portion therein. In this case, the exciter 13 can be disposed not on the back side of the diaphragm 11 but on, for example, the lateral side of the diaphragm 11, thereby heightening the degree of freedom of disposing the exciter 13.

Furthermore, the vibration-transmitter 15 may be a wire member stretched between the diaphragm 11 and the excitation part of the exciter 13. The wire member is connected in a tensed state to the diaphragm 11 and is thereby capable of transmitting vibrations from the exciter 13 to the diaphragm 11. This configuration heightens the degree of freedom of installing the diaphragm 11, for example, by hanging the diaphragm 11 from a ceiling or wall surface with wire members.

The disposition of the vibration-transmitter 15 is not limited to configurations in which one vibration-transmitter is connected to one diaphragm 11, and use may be made of a configuration in which a plurality of vibration-transmitters have been connected to one diaphragm 11. In this case, exciters may have been separately connected to the respective vibration-transmitters.

Next, the diaphragm 11 is explained in greater detail.

The diaphragm 11 resonates when the loss coefficient thereof, which indicates vibration-damping properties, is low. Especially when the diaphragm 11 is indirectly operated via the vibration-transmitter 15, this diaphragm 11 tends to vibrate freely and it is difficult to prevent resonance by forced vibrations caused by the exciter 13. It is therefore necessary that the diaphragm 11 for the speaker device 100 should be one which has a high loss coefficient, i.e., high vibration-damping properties. The diaphragm 11 has a loss coefficient at 25° C. of preferably $1\times10^{-2}$ or higher, more preferably $2\times10^{-2}$ or higher, still more preferably $5\times10^{-2}$ or higher. However, too high loss coefficients result in excessive damping and a decrease in the efficiency of diaphragm function. Hence, it has the loss coefficient of preferably 5 or less, more preferably 2 or less, still more preferably 1 or less.

As for the loss coefficient, a value calculated by a half-width method is used. Denoting f as the resonant frequency of a material and W as a frequency width at a point decreased by −3 dB from the peak value of the amplitude h (namely, the point of (maximum amplitude) −3 [dB]), the loss coefficient is defined as a value represented by {W/f}. In order to prevent the resonance, the loss coefficient may be increased, namely, this means that the frequency width W becomes relatively large with respect to the amplitude h and the peak becomes broader.

Loss coefficient is a value inherent in a material, etc. For example, in the case of a glass sheet alone, the loss coefficient varies depending on the composition, relative density, etc. thereof. Loss coefficient can be determined by a dynamic modulus test such as a resonance method.

When the diaphragm 11 is operated via the vibration-transmitter 15, the diaphragm 11 that satisfactorily conforms to acoustic-wave vibrations is desired. This conformability is represented by longitudinal wave acoustic velocity; the higher the longitudinal wave acoustic velocity, the higher the conformability. The sheet-thickness-direction longitudinal wave acoustic velocity of one diaphragm 11 or, in the case of a diaphragm 11 including a plurality of substrates, the sheet-thickness-direction longitudinal wave acoustic velocity of at least one of the substrates is preferably $3.0\times10^3$ m/s or higher, more preferably $3.5\times10^3$ m/s or higher, still more preferably $4.0\times10^3$ m/s or higher.

The term "longitudinal wave acoustic velocity" means a velocity at which a longitudinal wave propagates in an object. The longitudinal wave acoustic velocity and the Young's modulus can be measured by the ultrasonic pulse method described in Japanese Industrial Standards (JIS-R1602-1995).

It is preferable that the diaphragm 11 includes two or more substrates and a given interlayer disposed between at least a pair of substrates among said substrates, in a specific configuration for obtaining a high loss coefficient and a high longitudinal wave acoustic velocity.

<Diaphragm Composite>

Figure 4:
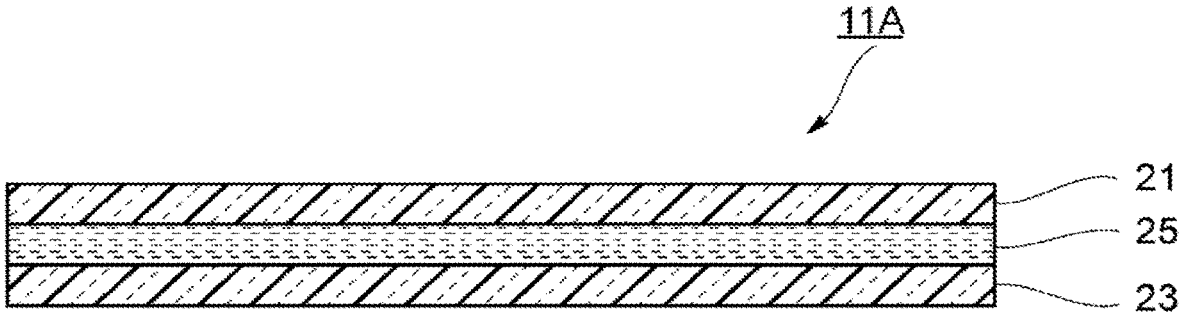
FIG. 4 is a diagrammatic cross-sectional view showing the layer configuration of a diaphragm composite including a plurality of substrates and an interlayer disposed between the substrates.

FIG. 4 is a diagrammatic cross-sectional view showing the layer configuration of a diaphragm composite 11A including a plurality of substrates and an interlayer disposed between the substrates, as another example of the diaphragm 11.

The diaphragm composite 11A includes a pair of substrates 21 and 23 and an interlayer 25 disposed between the substrate 21 and the substrate 23. It is preferable that the substrates 21 and 23 have light transmitting properties, but the substrates may be ones having no light transmitting properties.

With respect to the materials of the substrates 21 and 23, the material of at least one of the substrates can be a light-transmitting material having a high longitudinal wave acoustic velocity, such as, for example, a glass sheet, a light-transmitting ceramic, or a single-crystal substance, e.g., sapphire.

(Interlayer)

As the interlayer 25, an organic material may be used. For example, a resin sheet or a pressure-sensitive adhesive layer such as a butyral resin (PVB) can be used. Furthermore, the interlayer 25 may be a liquid layer, e.g., a silicone. When the interlayer 25 is a sheet-shaped member, this member is easy to handle in production steps, and the production steps can be simplified. When the interlayer 25 is a liquid layer, a high loss coefficient is rendered possible. In particular, a still higher loss coefficient can be attained by controlling the viscosity and surface tension of a liquid layer to be within preferred ranges. It is believed that this is attributable to the fact that the substrates 21 and 23 as a pair each individually retain the vibrational properties without being fixed to each other, unlike the case where a pair of substrates 21 and 23 is bonded together by a pressure-sensitive adhesive layer interposed therebetween.

The smaller the thickness of the interlayer 25, the more preferable the interlayer 25 is, from the standpoints of maintaining high rigidity and transmitting vibrations. Specifically, the interlayer 25 has a thickness of preferably 100 μm or less, more preferably 50 μm or less, still more preferably 10 μm or less. A lower limit of the thickness of the interlayer 25 is preferably 0.01 μm or larger from the standpoints of production efficiency and durability.

When the interlayer 25 has a thickness not less than the thickness of the substrates 21 and 23, longitudinal wave acoustic velocity considerably decreases. It is hence preferable that an upper limit of the thickness of the interlayer 25 is not larger than the thickness of the substrates 21 and 23. The thickness of the interlayer 25 is more preferably 50% or less of the substrate thickness, still more preferably 10% or less of the substrate thickness.

In the case where the interlayer 25 is a liquid layer, the liquid layer preferably has a viscosity coefficient at 25° C. of $1\times10^{-4}$ to $1\times10^{3}$ Pa·s and a surface tension at 25° C. of 15-80 mN/m. In case where the viscosity thereof is too low, this liquid layer is less apt to transmit vibrations. In case where the viscosity thereof is too high, the two substrates 21 and 23 respectively on both sides of the liquid layer are fixed to each other to exhibit a vibration behavior as one substrate, becoming less effective in damping vibration due to resonance. Meanwhile, in case where the surface tension thereof is too low, the substrates have reduced adhesion therebetween and are less apt to transmit vibrations. In case where the surface tension thereof is too high, the two substrates respectively on both sides of the liquid layer are apt to be fixed to each other to exhibit a vibration behavior as one substrate, becoming less effective in damping vibration due to resonance.

The liquid layer has a viscosity coefficient at 25° C. of more preferably $1\times10^{-3}$ Pa·s or higher, still more preferably $1\times10^{-2}$ Pa·s or higher. The liquid layer has a viscosity coefficient at 25° C. of more preferably $1\times10^{2}$ Pa·s or less, still more preferably 1×10 Pa·s or less.

The liquid layer has a surface tension at 25° C. of more preferably 20 mN/m or higher, still more preferably 30 mN/m or higher.

The viscosity coefficient of the liquid layer can be measured with a rotational viscometer, etc.

The surface tension of the liquid layer can be measured by a ring method, etc.

In case where the liquid layer has too high a vapor pressure, some of this liquid layer may vaporize, making the diaphragm composite unable to perform its function. The liquid layer hence has a vapor pressure at 25° C. and 1 atm of preferably $1\times10^{4}$ Pa or less, more preferably $5\times10^{3}$ Pa or less, still more preferably $1\times10^{3}$ Pa or less. In the case where the liquid layer has a high vapor pressure, a seal or the like may be provided to the diaphragm composite in order to prevent the liquid layer from vaporizing. In this case, however, it is necessary that the seal material should not inhibit the diaphragm composite from vibrating.

It is preferable that the liquid layer is chemically stable and does not react with either of the substrates in contact with the liquid layer. The term "chemically stable" means, for example, that the liquid layer is less apt to be altered (deteriorated) by light irradiation and undergoes none of solidification, vaporization, decomposition, discoloration, chemical reaction with the substrates, and the like at least in the temperature range of −20° C. to 70° C.

Examples of ingredients usable as the liquid layer include water, oils, organic solvents, liquid polymers, ionic liquids, and mixtures of two or more of these.

More specific examples thereof include propylene glycol, dipropylene glycol, tripropylene glycol, straight silicone oils (dimethyl silicone oil, methyl phenyl silicone oil, and methyl hydrogen silicone oil), modified silicone oils, acrylic-acid-based polymers, liquid polybutadiene, glycerin paste, fluorochemical solvents, fluororesins, acetone, ethanol, xylene, toluene, water, mineral oil, and mixtures of two or more of these. It is preferable that the liquid layer includes at least one member selected from the group consisting of propylene glycol, a dimethyl silicone oil, a methyl phenyl silicone oil, a methyl hydrogen silicone oil, and modified silicone oils, among those. It is more preferable that the liquid layer includes propylene glycol or a silicone oil as a main component.

Also usable as the liquid layer besides those ingredients is a slurry containing particles dispersed therein. Although the liquid layer preferably is a homogeneous fluid from the standpoint of improving the loss coefficient, the slurry is effective in the case of imparting design attractiveness or a function, such as coloration or fluorescence, to the diaphragm composite 11A.

The content of the particles in the liquid layer is preferably 0-10 vol %, more preferably 0-5 vol %.

The particles have a particle diameter of preferably 10 nm to 1 μm, more preferably 0.5 μm or less, from the standpoint of preventing sedimentation.

The liquid layer may contain a fluorescent material from the standpoint of imparting design attractiveness or a function. This liquid layer may be either a slurry liquid layer which contains a particulate fluorescent material dispersed therein or a homogeneous liquid layer in which a liquid fluorescent material has been mixed. Accordingly, the optical function, such as absorbing light and emitting light, can be imparted to the diaphragm composite 11A.

(Substrates)

The diaphragm composite 11A to be used in the speaker device 100 according to the present invention includes at least a pair of substrates 21 and 23 so as to sandwich the interlayer 25 therebetween along the thickness direction. When one substrate 21 resonates in cases when the interlayer 25 is a liquid layer, then the other substrate 23 does not resonate or the resonant vibration of the other substrate 23 can be damped. Hence, the diaphragm composite 11A can have a higher loss coefficient than single substrates.

It is preferable that, of the pair of substrates 21 and 23, one substrate and the other substrate have different peak top values of resonant frequency. It is more preferable that the ranges of resonant frequency of the two substrates do not overlap each other. However, even though the ranges of resonant frequency of the substrates 21 and 23 overlap each other or the two substrates have the same peak top value, the presence of the interlayer, preferably a liquid layer, prevents the resonance of one substrate from causing synchronous vibration to the other substrate and thereby reducing the resonance to some degree. A high loss coefficient can hence be obtained as compared with the case of single substrates.

More specifically, denoting Qa and wa respectively as the resonant frequency (peak top) and the half-width of resonance amplitude of one of the substrates and denoting Qb and wb respectively as the resonant frequency (peak top) and the half-width of resonance amplitude of the other substrate, it is preferable that the relationship represented by the following [formula 1] is satisfied.

$$(wa+wb)/4<|Qa-Qb| \quad \text{[formula 1]}$$

The larger the value of the left side of [formula 1], the larger the difference (|Qa−Qb|) in resonant frequency between the two substrates and the higher the loss coefficient. It is hence preferable that the two substrates have such properties.

Accordingly, it is more preferable that the following [formula 2] is satisfied, and it is still more preferable that the following [formula 3] is satisfied.

$$(wa+wb)/2<|Qa-Qb| \quad \text{[formula 2]}$$

$$(wa+wb)/1<|Qa-Qb| \quad \text{[formula 3]}$$

The resonant frequency (peak top) and half-width of resonance amplitude of each substrate can be determined by the same method as the loss coefficient of the diaphragm composite.

It is preferred that the mass difference between the two substrates as a pair is smaller, and it is more preferred that there is no mass difference therebetween. In cases when the substrates have different mass, the resonance of the lighter substrate can be reduced by the heavier substrate but it is difficult to reduce the resonance of the heavier substrate by the lighter substrate. This is because if the mass ratio is imbalanced, vibrations due to resonance cannot theoretically be mutually eliminated because of the difference in inertial force.

The mass ratio between substrate A and substrate B, which is represented by (substrate A/substrate B), is preferably 0.1-10.0 (from 1/10 to 10/1), more preferably 0.8-1.25 (from 8/10 to 10/8), still more preferably 0.9-1.1 (from 9/10 to 10/9), yet still more preferably 1.0 (10/10).

The smaller the thicknesses of the two substrates, the more likely the substrates are to adhere to each other with the interlayer, preferably the liquid layer, interposed therebetween and the smaller the amount of energy necessary for vibrating the substrates. Hence, for use in diaphragm applications as in loudspeakers, the smaller the substrate thicknesses, the better. Specifically, each of the two substrates has the sheet thickness of preferably 15 mm or less, more preferably 10 mm or less, still more preferably 5 mm or less, yet still more preferably 3 mm or less, even still more preferably 1.5 mm or less, even yet still more preferably 0.8 mm or less. Meanwhile, if the thickness is too small, the impact of surface defects of the substrates easily becomes noticeable, cracks are likely to occur, and strengthening treatment becomes difficult. Hence, each substrate has the thickness of preferably 0.01 mm or larger, more preferably 0.05 mm or larger.

For use in opening member applications in buildings or vehicles, for which the occurrence of an abnormal noise attributed to a resonance phenomenon is reduced, the substrates have the thicknesses of each preferably 0.5-15 mm, more preferably 0.8-10 mm, still more preferably 1.0-8 mm.

It is preferable, for use in diaphragm applications, that at least one of the pair of substrates has a high loss coefficient, because this enables the diaphragm composite to show enhanced vibration damping. Specifically, the substrate(s) has the loss coefficient at 25° C. of preferably $1\times10^{-4}$ or higher, more preferably $3\times10^{-4}$ or higher, still more preferably $5\times10^{-4}$ or higher. It is more preferable that both of the pair of substrates have that loss coefficient.

The loss coefficient of each substrate can be determined by the same method as the loss coefficient of the diaphragm 11 described above.

It is preferable, for use in diaphragm applications, that at least one of the substrates has a high longitudinal wave acoustic velocity in the sheet thickness direction, because the sound reproducibility in a high-frequency region is enhanced. Specifically, the substrate(s) has the longitudinal wave acoustic velocity of preferably $4.0\times10^3$ m/s or higher, more preferably $5.0\times10^3$ m/s or higher, still more preferably $6.0\times10^3$ m/s or higher. There is no particular upper limit, but the longitudinal wave acoustic velocity of the substrate is preferably $7.0\times10^3$ m/s or less from the standpoints of substrate productivity and raw material cost. It is more preferable that both of the pair of substrates satisfy that acoustic velocity.

The acoustic velocity of each substrate can be measured by the same method as the longitudinal wave acoustic velocity of the diaphragm 11 described above.

In the case where the substrates are glass sheets, the composition of each glass sheet is not particularly limited. However, the contents of components thereof are, for example, preferably in the following ranges.

40-80 mass % $SiO_2$, 0-35 mass % $Al_2O_3$, 0-15 mass % $B_2O_3$, 0-20 mass % MgO, 0-20 mass % CaO, 0-20 mass % SrO, 0-20 mass % BaO, 0-20 mass % $Li_2O$, 0-25 mass % $Na_2O$, 0-20 mass % $K_2O$, 0-10 mass % $TiO_2$, and 0-10 mass % $ZrO_2$. These components account for at least 95 mass % of the entire glass.

More preferably, the glass sheet has the composition including the following components in amounts within the following ranges.

55-75 mass % $SiO_2$, 0-25 mass % $Al_2O_3$, 0-12 mass % $B_2O_3$, 0-20 mass % MgO, 0-20 mass % CaO, 0-20 mass % SrO, 0-20 mass % BaO, 0-20 mass % $Li_2O$, 0-25 mass % $Na_2O$, 0-15 mass % $K_2O$, 0-5 mass % $TiO_2$, and 0-5 mass % $ZrO_2$. These components account for at least 95 mass % of the entire glass.

The lower the specific gravity of each substrate, the smaller the amount of energy necessary for vibrating the substrate. Specifically, in the case where the substrates are glass sheets, each glass sheet has a specific gravity of preferably 2.8 or less, more preferably 2.6 or less, still more preferably 2.5 or less. Although there is no particular lower limit, the substrate has the lowest specific gravity of preferably 2.2 or higher.

A specific elastic modulus is a value obtained by dividing the substrate's Young's modulus by the density, and the higher the specific elastic modulus of the substrate, the higher the rigidity of the substrate. Specifically, each substrate has a specific elastic modulus of preferably $2.5\times10^7$ $m^2/s^2$ or higher, more preferably $2.8\times10^7$ $m^2/s^2$ or higher, still more preferably $3.0\times10^7$ $m^2/s^2$ or higher. Although there is no particular upper limit, the substrate has the highest specific elastic modulus of preferably $4.0\times10^7$ $m^2/s^2$ or less.

(Properties of the Diaphragm Composite and Configuration Examples Thereof)

The higher the loss coefficient of the diaphragm composite 11A, the greater the vibration damping. Higher loss coefficients are hence preferred. The diaphragm composite 11A to be used in the speaker device 100 has the loss coefficient at 25° C. of $1\times10^{-2}$ or higher, preferably $2\times10^{-2}$ or higher, more preferably $4\times10^{-2}$ or higher, especially preferably $5\times10^{-2}$ or higher.

For the longitudinal wave acoustic velocity in the sheet-thickness-direction of the diaphragm composite 11A, the higher the acoustic velocity is, the more the reproducibility of high-frequency sounds in the diaphragm is improved. Hence, the diaphragm composite 11A has the longitudinal wave acoustic velocity in the sheet-thickness-direction of preferably $4.0\times10^3$ m/s or higher, more preferably $5.0\times10^3$ m/s or higher, still more preferably $6.0\times10^3$ m/s or higher. Although there is no particular upper limit, the upper limit is preferably $7.0\times10^3$ m/s or less.

In cases when the diaphragm composite 11A has a high linear transmittance, this diaphragm composite 11A can be applied as a light-transmitting member. Because of this, the diaphragm composite 11A has a visible-light transmittance of preferably 10% or higher, more preferably 30% or higher, still more preferably 50% or higher, yet still more preferably 70% or higher, even yet still more preferably 90% or higher, as determined in accordance with Japanese Industrial Standards (JIS R3106-1998).

It is useful to make the refractive indices suitable to increase the transmittance of the diaphragm composite 11A. Specifically, when the substrates 21 and 23 and the interlayer 25, which constitute the diaphragm composite 11A, have closer refractive indices each other, the more reflection or interference at the boundaries therebetween are prevented. Such configuration is hence preferred. In particular, the difference between the refractive index of the interlayer 25 and the refractive index of each of the pair of substrates 21 and 23 in contact with the interlayer 25 is preferably 0.2 or less, more preferably 0.1 or less, still more preferably 0.01 or less.

At least one of the substrates 21 and 23, and/or the interlayer 25, as components of the diaphragm composite 11A, can be colored. This is useful when design attractiveness is desired or a function, such as IR cut, UV cut, or privacy glass, is desired for the diaphragm composite 11A.

The substrates 21 and 23 suffice as the two or more substrates for constituting the diaphragm composite 11A, but three or more substrates may be used. In either case, the substrates which all differ in composition may be used or substrates which all have the same composition may be used. Substrates having the same composition may be used in combination with a substrate having a different composition. Among others, it is preferred to use two or more kinds of substrates differing in composition, from the standpoint of vibration damping.

Similarly, as to the mass and thickness, the substrates may be all different, may be all the same, or some may be different. Above all, from the standpoint of vibration damping, all of the constituent substrates preferably have the same mass.

A physically strengthened glass sheet or a chemically strengthened glass sheet may be used as at least one of the substrates 21 and 23 constituting the diaphragm composite 11A. This is useful in preventing the diaphragm composite from breaking. When an increase in the strength of the diaphragm composite is desired, it is preferable that a physically strengthened glass sheet or a chemically strengthened glass sheet is used as the substrate located in an outermost surface of the diaphragm composite 11A, and it is more preferable that all of the constituent glass sheets are each a physically strengthened glass sheet or a chemically strengthened glass sheet.

From the standpoint of increasing the longitudinal wave acoustic velocity and the strength, it is also useful to use a crystallized glass or a phase-separated glass as a substrate. Especially when an increase in the strength of the diaphragm composite is desired, it is preferred to use the crystallized glass or the phase-separated glass as the substrate located in an outermost surface of the diaphragm composite.

A coating layer or a film layer may be formed on at least one outermost surface of the diaphragm composite 11A, so long as the effects of the present invention are not impaired. Formation of a coating layer or attachment of a film layer is suitable for scratch protection, etc.

It is preferred that the coating layer or the film layer has a thickness of ⅕ or less of the sheet thickness of the substrate. The coating and the film can be conventionally known ones. Examples of the coating include a water-repellent coating, a hydrophilic coating, a water sliding coating, an oil-repellent coating, a light reflection preventive coating, and a heat shielding coating. Examples of the film include a shatterproof film for glass, a color film, a UV cut film, an IR cut film, a heat-shielding film, an electromagnetic wave shielding film, and a screen film for projectors.

The shape of the diaphragm composite 11A can be appropriately designed in accordance with applications, and may be a flat plate-like shape or a curved surface shape.

For example, in order to raise the output sound pressure level in a low-frequency range, the diaphragm composite 11A can be made to have a structure including an enclosure or a baffle plate. Although the material of the enclosure or baffle plate is not particularly limited, it is preferable to use the diaphragm 11 described above.

A frame may be provided to at least one outermost surface of the diaphragm composite 11A so long as the effects of the present invention are not impaired. The frame is useful, for example, when it is desired to enhance the rigidity of the diaphragm composite 11A or maintain a curved surface shape of the diaphragm composite 11A. As the material of the frame, a conventionally known material may be used. Examples, which can be used as the material, include ceramics and single-crystal materials such as $Al_2O_3$, SiC, $Si_3N_4$, mullite, zirconia, yttria, and YAG, metal and alloy materials such as steel, aluminum, titanium, magnesium, and tungsten carbide, composite materials such as FRPs, resin materials such as acrylics and polycarbonates, glass materials, and wood.

The frame to be used has a weight preferably 20% or less, more preferably 10% or less, of the weight of the substrate.

The liquid layer can be prevented from leaking out though the frame by disposing a seal material between the diaphragm composite 11A and the frame.

At least some of an outer circumferential edge portion of the diaphragm composite 11A may be sealed by a member which does not hinder the vibration of the diaphragm composite 11A. As this seal material, a highly elastic rubber, a resin, a gel, etc. can be employed.

As the resin for the seal material, acrylic, cyanoacrylate-based, epoxy-based, silicone-based, urethane-based, and phenolic resins can be used. Examples of curing methods include one-pack type, two-pack mixing type, heat curing, ultraviolet curing, and visible light curing.

A thermoplastic resin (hot-melt bond) is also usable. Examples thereof include (ethylene/vinyl acetate)-based, polyolefin-based, polyamide-based, synthetic rubber-based, acrylic, and polyurethane-based resins.

As the rubber, natural rubber, synthetic natural rubber, butadiene rubber, styrene-butadiene rubber, butyl rubber, nitrile rubber, ethylene-propylene rubber, chloroprene rubber, acrylic rubber, chlorosulfonated polyethylene rubber (Hypalon), urethane rubber, silicone rubber, fluororubber, ethylene-vinyl acetate rubber, epichlorohydrin rubber, polysulfide rubber (Thiokol), and hydrogenated nitrile rubber can be used.

When the thickness of the seal material is too small, sufficient strength is not ensured. When the thickness thereof is too large, the seal member may hinder vibrations. Consequently, the seal material has a thickness of preferably 10 μm or larger and up to 5 times the overall thickness of the diaphragm composite, and is more preferably 50 μm or larger and smaller than the overall thickness of the diaphragm composite.

At least some of the main surfaces of the substrates 21 and 23 facing each other may be coated with the seal material in order to, for example, prevent separation at the interface between the substrate 21 or 23 and the interlayer 25 of the diaphragm composite 11A, so long as the effects of the present invention are not impaired. In this case, the seal material-coated portion has the area of preferably 20% or less, more preferably 10% or less, still more preferably 5% or less, of the area of the interlayer 25 so that it does not hinder vibrations.

In order to enhance the sealing performance, edge portions of the substrates 21 and 23 can be processed into an appropriate shape. For example, edge portions of at least one of the substrates may be processed by C-chamfering (the substrate has a trapezoidal cross-sectional shape) or R-chamfering (the substrate has an approximately are cross-sectional shape), thereby increasing the area of contact between the seal material and the substrate. Thus, the strength of adhesion between the seal material and the substrate is enhanced.

<Application Examples> The diaphragm (diaphragm 11, diaphragm composite 11A) of the speaker device 100 explained above can be made usable as a display, for example, by disposing a display screen on the viewing-direction (Va direction in FIG. 2) back side of the diaphragm, because the diaphragm has an advantage in that the main surfaces thereof can have a large area. It is also possible to dispose light-emitting elements on a surface of the diaphragm to impart a display function thereto. Furthermore, it is possible to apply a screen film to the diaphragm to impart thereto the function of displaying projected images. Moreover, the diaphragm can be used as a window glass.

Examples of applications of the speaker device 100, which can have the configurations described above, are explained below in greater detail.

The diaphragm of the speaker device 100 can be utilized, for example, as a member for electronic devices or as a diaphragm for use in a full-range loudspeaker, a loudspeaker for reproducing a low-pitched sound range of 15 Hz to 200 Hz, a loudspeaker for reproducing a high-pitched sound range of 10 kHz to 100 kHz, a large loudspeaker having a diaphragm area of 0.2 $m^2$ or more, a small loudspeaker having a diaphragm area of 3 $cm^2$ or less, a flat loudspeaker, a cylindrical loudspeaker, a transparent loudspeaker, a mobile device cover glass functioning as a loudspeaker, a TV display cover glass, a display outputting video signals and audio signals from the same surface, a loudspeaker for wearable displays, an electronic display device, and lighting equipment. In addition, the diaphragm can be used as a diaphragm or vibration sensor for microphones.

The speaker device 100 can be used as an interior vibration member of transport machinery such as vehicle, or as an in-vehicle/in-machine loudspeaker. The speaker device 100 can be made into, for example, a side-view mirror, a sun visor, an instrument panel, a dashboard, a ceiling, a door, or other interior panels, each functioning as a loudspeaker. In addition, such a member can also be made to function as a microphone and a diaphragm for active noise control.

The speaker device 100 can be used also as an opening member for use in, for example, buildings, transport machinery, etc. In this case, a function such as IR cut, UV cut and coloration can be imparted to the diaphragm.

At the time when the speaker device 100 is applied as some of an opening member, the speaker device 100 can have a configuration in which the vibration-transmitter 15 connected to the exciter 13 has been connected to one or both main surfaces of the diaphragm. This configuration facilitates reproduction of the sound in a high-frequency region that has been conventionally difficult to reproduce. In addition, since the size, shape, color, etc. of the diaphragm can be highly freely selected and a design can be applied thereto, an opening member also with excellent designability can be obtained.

Furthermore, by sampling sound or vibration by a sound collecting microphone or a vibration detector disposed on the surface or in the vicinity of the diaphragm and generating in-phase or anti-phase vibration in the diaphragm, the sound or vibration sampled can be amplified or canceled.

More specifically, the speaker device 100 can be used as an in-vehicle loudspeaker, an outside-the-vehicle loudspeaker, and a windshield, side glass, rear glass, or roof glass having a sound insulating function. The speaker device 100 can also be used as a vehicle window, structural member, or decorative plate that has improved water-repellency, snow accretion resistance, ice accretion resistance or antifouling property due to sonic vibration. Specifically, it can be used as an automotive window glass, mirror, lens or sensor, and a cover glass thereof.

When the speaker device is applied as the opening member for building, it can be employed as window glass, door glass, roof glass, an interior material, an exterior material, a decorative material, a structural material, an outer wall, and a solar cell cover glass, each functioning as a diaphragm and a vibration detecting device. Furthermore, the above-described water repellency, snow accretion resistance and antifouling property can be enhanced by the sonic vibration.

(Method for Producing the Diaphragm Composite)

The diaphragm composite 11A described above can be obtained by forming an interlayer 25 between a pair of substrates 21 and 23.

Methods for forming a liquid layer as the interlayer 25 between a pair of substrates 21 and 23 are not particularly limited. Examples thereof include: a method in which a liquid layer is formed on a surface of a substrate and another substrate is disposed thereon; a method in which substrates each having a liquid layer formed on a surface thereof are put together; and a method in which a liquid layer is poured into the space between two substrates.

Methods for forming the liquid layer are also not particularly limited, and examples thereof include: applying the liquid to a substrate surface; and spraying the liquid over the surface.

The present invention is not limited to the embodiments described above, and the configurations of the embodiments can be combined with each other or can be modified or applied by a person skilled in the art on the basis of the statements in the description and known techniques. Such combinations, modifications, etc. are expectable according to the present invention and are included in the claimed range.

EXAMPLES

The present invention is explained below in detail by reference to Examples, but the invention is not limited thereto.

Evaluation Example 1

Glass substrate A having dimensions of 300 mm×300 mm×0.5 mm was prepared as substrate 1, which was one of a pair of substrates. A silicone oil (KF-96, manufactured by Shin-Etsu Chemical Co., Ltd.) having a viscosity coefficient of 3,000 mPa·s was applied as a liquid layer to a surface of the substrate using a dispenser (SHOTMASTER 400DS-s, manufactured by Musashi Engineering). Furthermore, glass substrate B having dimensions of 300 mm×300 mm×0.5 mm as substrate 2, which was the other of the pair of substrates, was brought into close contact with the glass substrate A through the liquid layer and laminated thereto so as to result in a liquid thickness of $3_R$m. Thus, a diaphragm composite including the two glass substrates and the liquid layer were obtained.

The compositions (mass %) and property values of the glass substrate A and glass substrate B are shown below.

(Glass Substrate A) 61.5% $SiO_2$, 20% $Al_2O_3$, 1.5% $B_2O_3$, 5.5% MgO, 4.5% CaO, 7% SrO; density, 2.7 g/cm$^3$; Young's modulus, 85 GPa; specific elastic modulus, $3.2\times10^7$ m$^2$/s$^2$ (Glass Substrate B) 60% $SiO_2$, 17% $Al_2O_3$, 8% $B_2O_3$, 3% MgO, 4% CaO, 8% SrO; density, 2.5 g/cm$^3$; Young's modulus, 77 GPa; specific elastic modulus, $3.1\times10^7$ m$^2$/s$^2$ A hollow cylindrical aluminum member having a rod length of 200 mm and a specific elastic modulus of 25 mm$^2$/s$^2$ was used as a rod member, and one end of the rod member was bonded to a rod-holding member made of an acrylic resin. This rod-holding member integrated with the rod member was bonded to the glass substrate B of the diaphragm composite. The portion of the rod-holding member where the rod-holding member was attached to the glass substrate B had an area of 3.1 cm$^2$. The other end of the rod member was connected to the excitation part of an exciter, the excitation part being made of an acrylic resin, so that vibrations were transmitted from the exciter to the diaphragm composite via the rod member and the rod-holding member.

Evaluation Example 2

A diaphragm composite was obtained in the same manner as in Evaluation Example 1, except that an acrylic-resin substrate having dimensions of 300 mm×300 mm×0.5 mm was used in place of the glass substrate A and that a PVB resin having a thickness of 500 μm was disposed as an interlayer. A rod-holding member having a rod member connected thereto was bonded to the diaphragm composite in the same manner as in Evaluation Example 1, and an exciter was connected to the other end of the rod member.

Evaluation Example 3

A $SiO_2$ glass sheet having dimensions of 300 mm×300 mm×0.5 mm was prepared and used as a diaphragm having a single-sheet configuration. A rod-holding member having a rod member connected thereto was bonded to the diaphragm in the same manner as in Evaluation Example 1, and an exciter was connected to the other end of the rod member.

Evaluation Example 4

A diaphragm composite including glass substrates A and B and a liquid silicone-oil layer as an interlayer was obtained in the same manner as in Evaluation Example 1. A rod member made of a nylon and having a length of 200 mm and a specific elastic modulus of 1 mm$^2$/s$^2$ was bonded to a rod-holding member in the same manner as in Evaluation Example 1, and an exciter was connected to the other end of the rod member.

<Evaluation Methods>

(Young's Modulus, Longitudinal Wave Acoustic Velocity, Density)

The diaphragm composites and single-sheet diaphragm of Evaluation Examples 1 to 4 were examined for Young's modulus E and acoustic velocity V at 25° C. with specimens having a length of 100 mm, a width of 100 mm, and a thickness of 0.5-1 mm by the ultrasonic pulse method described in Japanese Industrial Standards (JIS-R1602-1995) (DL35PLUS, manufactured by Olympus Co., Ltd. was employed). The longitudinal wave acoustic velocity of each diaphragm composite was determined by measuring the acoustic velocity in the sheet-thickness-direction.

The density p of each glass sheet was measured by Archimedes' method (AUX320, manufactured by Shimadzu Corp.) at 25° C.

(Resonant Frequency)

The diaphragm composites and single-sheet diaphragm of Evaluation Examples 1 to 4 were examined for resonant frequency in the following manner. A vibration exciter (ET139, manufactured by Labworks) was connected to the center of the lower surface of a specimen substrate (diaphragm composite or single-sheet diaphragm) having a length of 100-103 mm, a width of 100-103 mm, and a thickness of 1 mm, and sine-wave vibrations in the range of 30-10,000 Hz were applied to the specimen in an environment under a temperature of 25° C. Any response to the vibration application was detected with an acceleration pickup disposed at the center of the upper surface of the specimen substrate and analyzed for frequency response characteristics with an FFT analyzer (DS-3000, manufactured by ONO Sokki Co., Ltd.). The frequency at which the vibration amplitude h had been maximal was taken as resonant frequency f.

(Loss Coefficient)

The diaphragm composites and single-sheet diaphragm of Evaluation Examples 1 to 4 were evaluated for loss coefficient in terms of attenuation represented by W/f, where f is the resonant frequency of the material determined by the method shown above and W is a frequency width at a point decreased by −3 dB from the maximum amplitude h (namely, the point of (maximum amplitude) −3 [dB]).

(Viscosity Coefficient)

The viscosity coefficient of the silicone oil employed as a liquid layer was measured at 25° C. with a rotational viscometer (RVDV-E, manufactured by BROOKFIELD Inc.).

(Sound Pressure Level)

A voice signal of 50-10 kHz was input to the exciter at an operating voltage of 2 V, and the sound pressure level was measured with a precision noise meter (LA-3560, manufactured by ONO Sokki Co., Ltd.).

Some of the details shown above and the results of the measurements are summarized in Table 1.

TABLE 1

| | Evaluation Example 1 | Evaluation Example 2 | Evaluation Example 3 | Evaluation Example 4 |
|---|---|---|---|---|
| Substrate 1, material | glass substrate A | acrylic resin | $SiO_2$ glass (single sheet) | glass substrate A |
| Substrate 2, material | glass substrate B | glass substrate B | none | glass substrate B |
| Substrate size, mm | 300 square | 300 square | 300 square | 300 square |
| Sheet thicknesses (substrate 1, mm)/(substrate 2, mm) | 0.5/0.5 | 0.5/0.5 | 1.0/— | 0.5/0.5 |
| Material of interlayer | silicone | PVB | none | silicone |
| Thickness of interlayer, μm | 3 | 500 | none | 3 |
| Loss coefficient | $5.2 \times 10^{-2}$ | $1.1 \times 10^{-1}$ | $9.5 \times 10^{-3}$ | $5.2 \times 10^{-2}$ |
| Longitudinal wave acoustic velocity of diaphragm, m/s | 6100 | 4020 | 6000 | 6100 |
| Material and shape of rod member | hollow aluminum cylinder | hollow aluminum cylinder | hollow aluminum cylinder | nylon |
| Rod length, mm | 200 | 200 | 200 | 200 |
| Specific elastic modulus of rod member, $mm^2/s^2$ | 25 | 25 | 25 | 1 |
| Area of attachment portion of rod-holding member, $mm^2$ | $3.1 \times 10^2$ | $3.1 \times 10^2$ | $3.1 \times 10^2$ | $3.1 \times 10^2$ |
| Sound pressure level (operating voltage, 2 V; 1 kHz), dB | 70 | 65 | 70 | 40 |
| Resonance | not occurred | not occurred | rod separation due to resonance | not occurred |

In Evaluation Example 1, in which a diaphragm composite including two glass substrates and a liquid silicone layer sandwiched therebetween was excited through a rod member made of aluminum, the diaphragm composite had a loss coefficient at 25° C. of $5.2\times10^2$, which was higher than $1\times10^2$. This diaphragm composite had a longitudinal wave acoustic velocity of $6.1\times10^3$ m/s, which was higher than $3.0\times10^3$ m/s. When a 1-kHz voice signal was input, the diaphragm composite produced a sound having a sound pressure level of 70 dB, which was sufficient for listening. No resonance was observed during the excitation.

In Evaluation Example 2, in which a diaphragm composite including a PVB resin sandwiched between an acrylic-resin substrate and a glass substrate was excited through a rod member made of aluminum, the diaphragm composite had a loss coefficient at 25° C. of $1.1\times10^1$, which was higher than $1\times10^2$. This diaphragm composite had a longitudinal wave acoustic velocity of $4.02\times10^3$ m/s, which was higher than $3.0\times10^3$ m/s. When a 1-kHz voice signal was input, the diaphragm composite produced a sound having a sound pressure level of 65 dB, which was sufficient for listening. No resonance was observed during the excitation.

In Evaluation Example 3, in which a single-sheet diaphragm of $SiO_2$ glass was excited through a rod member made of aluminum, the diaphragm had a loss coefficient at 25° C. of $9.5\times10^{-3}$, which was lower than $1\times10^{-2}$. This diaphragm had a longitudinal wave acoustic velocity of $6.0\times10^3$ m/s, which was higher than $3.0\times10^3$ m/s. When a 1-kHz voice signal was input, the diaphragm composite produced a sound having a sound pressure level of 70 dB, which was sufficient for listening. However, resonance occurred and this resulted in separation of the rod member. Namely, Evaluation Example 3 was inferior in bonding strength to Evaluation Examples 1 and 2.

In Evaluation Example 4, in which a diaphragm composite including two glass substrates and a liquid silicone layer sandwiched therebetween was excited through a rod member made of a nylon, the diaphragm composite had a loss coefficient at 25° C. of $5.2\times10^{-2}$, which was higher than $1\times10^{-2}$. This diaphragm composite had a longitudinal wave acoustic velocity of $6.1\times10^3$ m/s, which was higher than $3.0\times10^3$ m/s. However, the rod member in this case had a specific elastic modulus of 1 $mm^2/s^2$, which was lower than 20 $mm^2/s^2$. Because of this, the sound produced by the diaphragm composite had a sound pressure level of 40 dB, indicating that the sound was difficult to listen. No resonance was observed during the excitation. Namely, Evaluation Example 4 was inferior in acoustic performance to Evaluation Examples 1 and 2.

In each of Evaluation Examples 1 to 4, the attachment portion of the rod-holding member had an area of 1/100 or less of the area of the main surface of the diaphragm composite or diaphragm. The rod-holding member hence did not impair the aesthetics of the diaphragm composite or diaphragm.

While the invention has been described in detail and with reference to specific embodiments thereof, it will be apparent to one skilled in the art that various changes and modifications can be made therein without departing from the spirit and scope thereof. This application is based on a Japanese patent application filed on Mar. 6, 2018 (Application No. 2018-039879), the entire contents thereof being incorporated herein by reference.

INDUSTRIAL APPLICABILITY

The speaker device according to the present invention retains sufficient acoustic performance and can exhibit excellent design without impairing the designability of the diaphragm, since the diaphragm therein has a high loss coefficient and the vibration-transmitter therein for transmitting vibrations to the diaphragm has a specific elastic modulus of 20 $mm^2/s^2$ or higher. Because of this, the speaker device is suitable for use as a member for electronic devices, an interior vibration member for transport machines, e.g., vehicles, a vehicle-mounted or machine-mounted loudspeaker, and an opening member for use in buildings, transport machines, etc.

REFERENCE SIGNS LIST

11 Diaphragm
11A Diaphragm composite
13 Exciter
15 Vibration-transmitter
17 Rod member
19 Rod-holding member
21, 23 Substrate
25 Interlayer
100 Speaker device

The invention claimed is:

1. A speaker device comprising
a diaphragm,
an exciter that generates vibration in response to an input electrical signal, and
a vibration-transmitter that is connected to both the diaphragm and the exciter and transmits the vibration of the exciter to the diaphragm,
wherein the diaphragm has a loss coefficient at 25° C. of $1\times10^{-2}$ or higher and
the vibration-transmitter has a specific elastic modulus of 20 $mm^2/s^2$ or higher.

2. The speaker device according to claim 1, wherein the diaphragm has light transmitting properties.

3. The speaker device according to claim 1, wherein the diaphragm has a longitudinal wave acoustic velocity in a sheet-thickness-direction of $3.0\times10^3$ m/s or higher.

4. The speaker device according to claim 1, wherein a joint surface where the vibration-transmitter bonds to the diaphragm has an area of 1/100 or less of an area of the diaphragm.

5. The speaker device according to claim 1, wherein the vibration-transmitter comprises a rod member connected to both the diaphragm and the exciter.

6. The speaker device according to claim 5, wherein the rod member is connected to the diaphragm by a rod-holding member.

7. The speaker device according to claim 1, wherein the diaphragm is a diaphragm composite comprising two or more substrates,
the diaphragm composite comprises an interlayer of a resin or liquid between at least one pair of substrates among the substrates.

8. The speaker device according to claim 7, wherein the interlayer is a liquid layer having a thickness of 100 μm or less.

9. The speaker device according to claim 8, wherein the liquid layer has a viscosity coefficient at 25° C. of $1\times10^{-4}$ to $1\times10^3$ Pa·s and a surface tension at 25° C. of 15-80 mN/m.

10. The speaker device according to claim 8, wherein the liquid layer comprises at least one member selected from the group consisting of propylene glycol, a dimethyl silicone oil, a methyl phenyl silicone oil, a methyl hydrogen silicone oil, and modified silicone oils.

11. The speaker device according to claim 7, wherein each of the substrates that constitute the at least one pair of substrates among the substrates has a specific elastic modulus of $2.5\times10^7$ $m^2/s^2$ or higher.

12. The speaker device according to claim 7, wherein a mass ratio between the two substrates constituting the one pair of substrates is 0.1-10.0.

13. The speaker device according to claim 7, wherein each of the two substrates constituting the one pair of substrates has a thickness of 0.01-15 mm.

14. The speaker device according to claim 7, wherein the diaphragm composite comprises at least one of a physically strengthened glass sheet or a chemically strengthened glass sheet.

15. The speaker device according to claim 7, wherein the diaphragm composite includes a coating layer or film layer formed on at least one outermost surface of the diaphragm composite.

16. The speaker device according to claim 7, wherein the diaphragm composite comprises a seal material that does not hinder vibration of the diaphragm composite and is provided to at least some of an outer peripheral edge portion of the diaphragm composite.

17. The speaker device according to claim 5, wherein a length of the rod member is 1 cm or longer and 500 cm or shorter.

18. The speaker device according to claim 6, wherein the rod member and the rod-holding member are each made of a light-transmitting material.

19. The speaker device according to claim 6, wherein the rod-holding member and the diaphragm are connected by inserting some of the diaphragm into the rod-holding member.

20. The speaker device according to claim 1, wherein the vibration-transmitter comprises a wire connected in a tensed state between the diaphragm and an excitation part of the exciter.

* * * * *